US006776400B1

(12) United States Patent
Laneuville

(10) Patent No.: US 6,776,400 B1
(45) Date of Patent: Aug. 17, 2004

(54) AIR INTAKE DEFLECTOR FOR TWIN CARBURETORS

(76) Inventor: Patrick Laneuville, 255, route 261 nord, St-Sylvère, Quebec (CA), H1X 1M4

( * ) Notice: Subject to any disclaimer, the term of this patent is extended or adjusted under 35 U.S.C. 154(b) by 0 days.

(21) Appl. No.: 10/359,321

(22) Filed: Feb. 7, 2003

(51) Int. Cl.[7] ..... F02M 13/02

(52) U.S. Cl. ..... 261/23.2; 55/385.3; 55/419; 55/463; 55/DIG. 28; 123/184.25; 123/198 E

(58) Field of Search ..... 261/23.2; 55/385.3, 55/419, 463, DIG. 28, 385.7; 123/184.25, 198 E; 454/152

(56) References Cited

U.S. PATENT DOCUMENTS 2,816,621 A * 12/1957 Weaver ..... 55/419
3,057,335 A * 10/1962 Osborne ..... 123/590
4,210,107 A 7/1980 Shaffer ..... 123/184.34
4,305,573 A 12/1981 Boje et al. ..... 123/403
4,592,316 A * 6/1986 Shiratsuchi et al. .... 123/195 C
4,772,299 A * 9/1988 Bogusz ..... 55/385.3
4,977,866 A 12/1990 Wilkins ..... 123/184.34
5,868,808 A * 2/1999 Henderson ..... 55/336

* cited by examiner

*Primary Examiner*—Richard L. Chiesa

(57) ABSTRACT

An air intake deflector to deflect air towards twin carburetors including a specifically sized and configured element inserted inside an existing air intake adaptor and the air intake deflector being situated between two separate spaced apart holes leading to two separate carburetors.

1 Claim, 3 Drawing Sheets

AIR INTAKE DEFLECTOR FOR TWIN CARBURETORS

BACKGROUND OF THE INVENTION

1. Field of the Invention

This invention relates generally to air intake deflectors but more particularly to an apparatus that deflects incoming air towards two separate carburetors for specific brands of ATVs.

2. Background

ATVs still use carburetors and more particularly, the Yamaha Banshee has a poorly designed air filter which has two separate spaced apart holes leading to two separate carburetors. When air travels towards the carburetors, because of the flat space between each holes leading to the carburetors, there is the formation of turbulence which reduces the efficiency of the engine.

Surprisingly, the manufacturer of this ATV hasn't focused much R&D efforts towards improving the air intake and thus the performance of its vehicle and there is no prior art that directly addresses this particular situation. Since there is already a large amount of such vehicles on the market and that they are still manufactured, there is a need for a device which improves air intake by reducing turbulence and consequently, improves engine performance.

SUMMARY OF THE INVENTION

A first object of the present invention is to provide a simple device that improves engine performance for a given type of twin carburetor ATV.

A second object is to provide a device which can be easily fitted into the existing air intake system of an engine by a user without requiring special skills.

A third object is to provide for the device to be factory installed or better still, molded right into the part into which it would normally be fitted, right at the manufacturing stage.

In order to do so, the invention is a specially fashioned piece of solid material which is affixed on an engine part which leads to the twin carburetors and at a location situated between two entry portholes.

The foregoing and other objects, features, and advantages of this invention will become more readily apparent from the following detailed description of a preferred embodiment with reference to the accompanying drawings, wherein the preferred embodiment of the invention is shown and described, by way of examples. As will be realized, the invention is capable of other and different embodiments, and its several details are capable of modifications in various obvious respects, all without departing from the invention. Accordingly, the drawings and description are to be regarded as Illustrative in nature, and not as restrictive.

BRIEF DESCRIPTION OF THE PREFERRED EMBODIMENT

Figure 1:
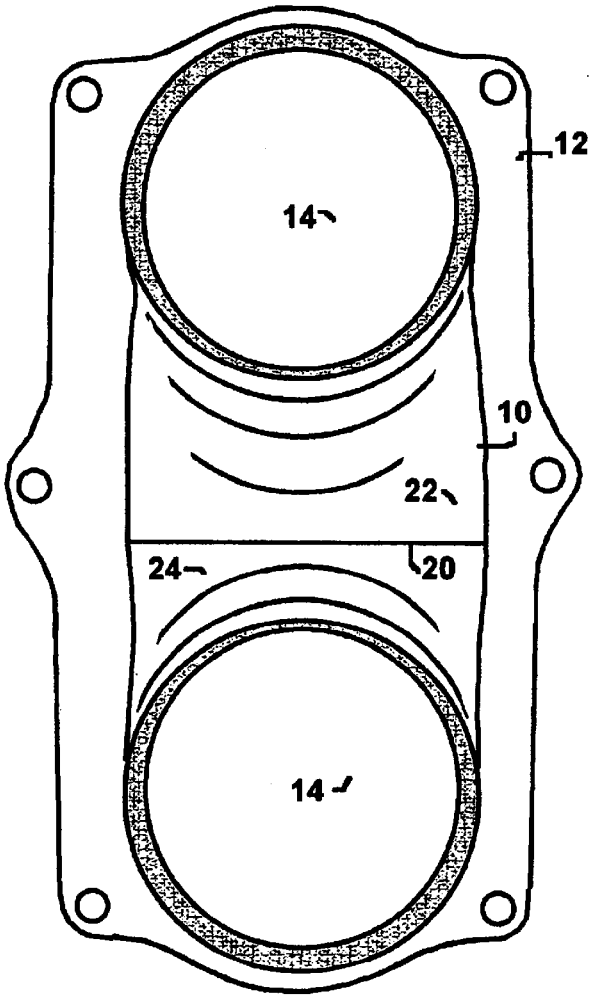

FIG. 1 Front view of the air intake deflector in position at the air intake module.

Figure 2:
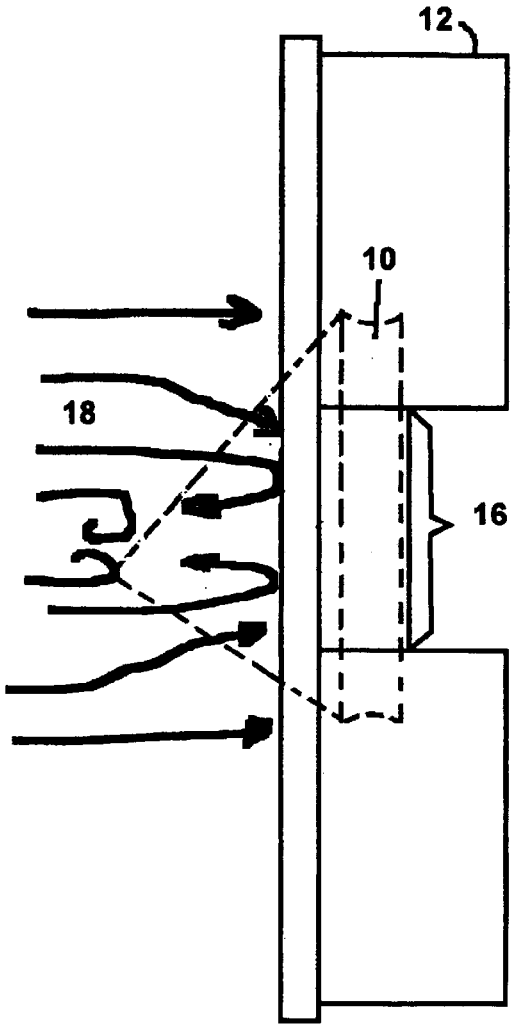

FIG. 2 Side view of the air deflector.

Figure 3:
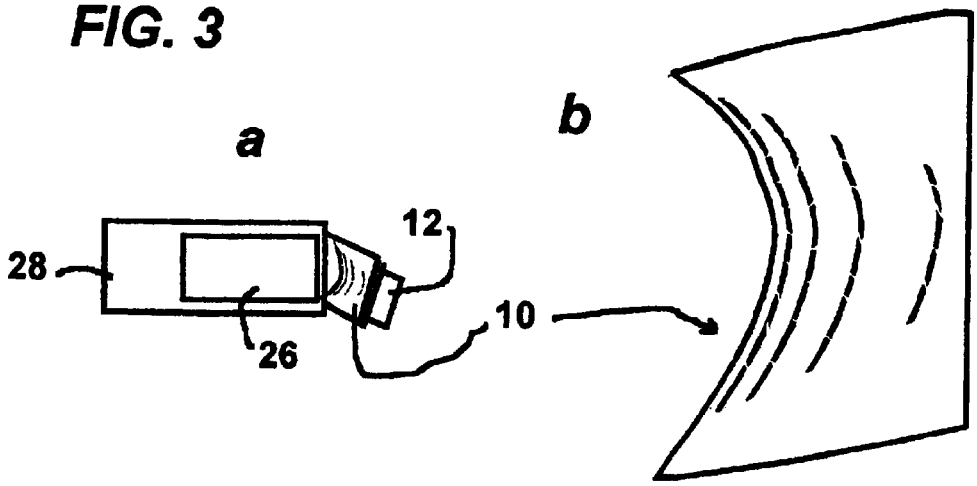

FIGS. 3*a,b* are side views of the air deflector in an air intake assembly.

Figure 4:
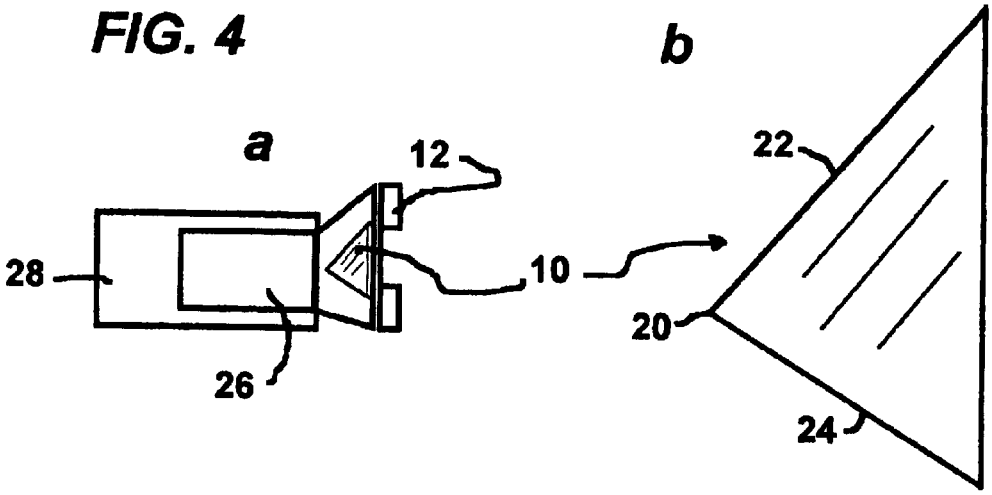

FIGS. 4*a,b* are other side views of the air deflector in an air intake assembly.

Figure 5:
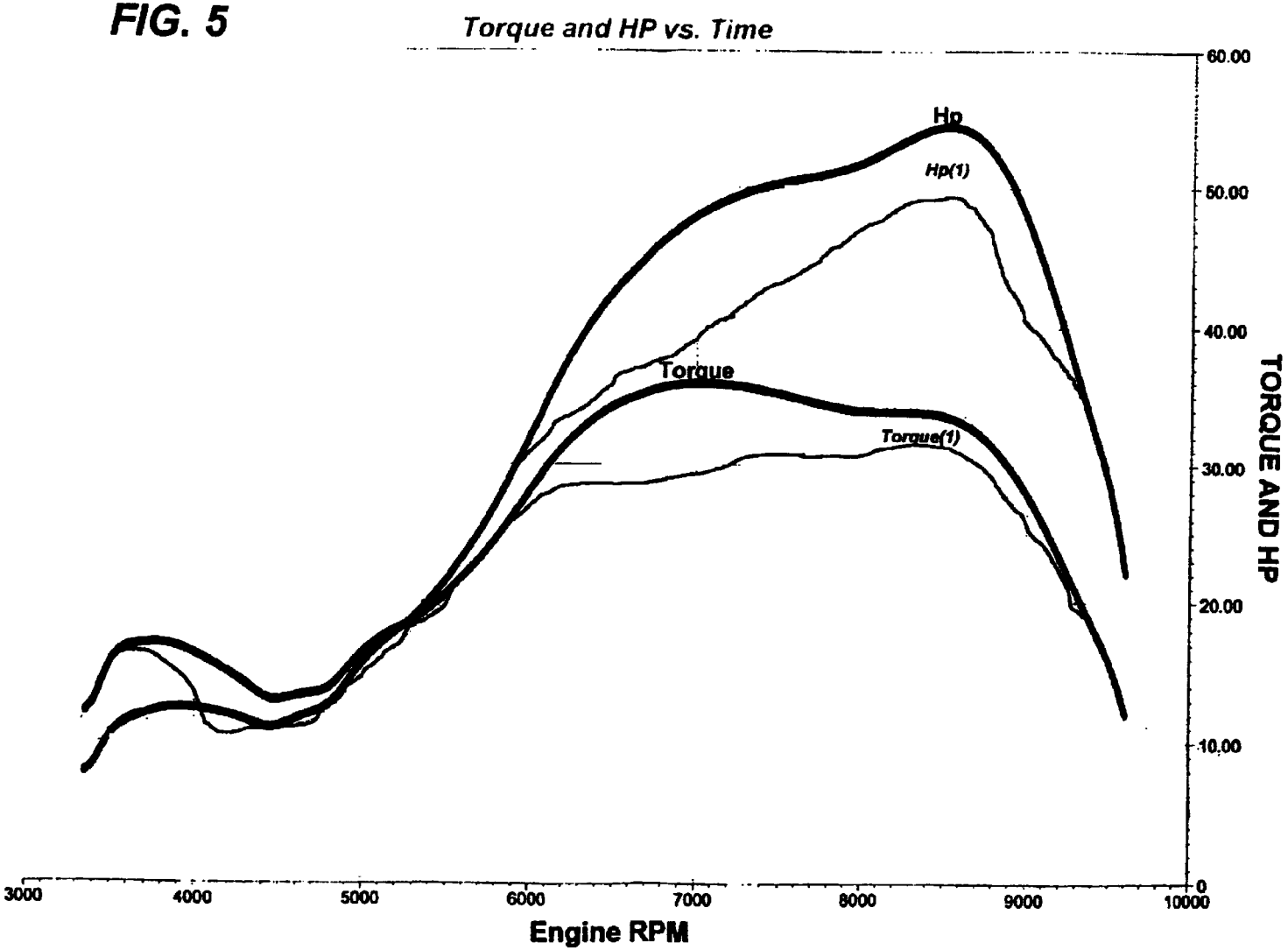

FIG. 5 Performance chart showing engine performance variations with and without the air deflector.

DETAILED DESCRIPTION OF THE PREFERRED EMBODIMENT

An air intake deflector for twin carburetors (10) which is inserted inside an existing air intake adaptor (12) which is itself part of an air intake assembly (28). This air intake deflector (10) is situated between two separate spaced apart holes (14) leading to two separate carburetors (not shown). As the air is sucked towards the two carburetors, it has to pass through two holes (14) but because of a flat space (16) between each of the holes (14), there is the creation of turbulence (18) which reduces the efficiency of the engine.

The air deflector (10) is a specifically fashioned element that directs the air flow with reduced turbulence by presenting a sloped surface starting at an apex (20) and sloping on two generally concave surfaces (22 and 24), one for each holes (14). The size and configuration of the air intake deflector (10) is dictated by the surrounding components: It would defeat the purpose to have it wider than the flat space (16) and the projection of the apex (20) is limited so that it does not interfere with other components, namely to position of an air filter (26). Soft rounded shapes are favored to maximize the fluidity of the air passing through. Other than that, there are no critical angles that are preferred over others.

FIG. 5 shows a graph illustrating the difference in performance between using the air deflector (10) shown as torque and HP on the bold lines and without the air deflector (10) on the thin lines.

What is claimed is:

1. An air intake deflector to deflect air towards twin carburetors comprising:

a specifically sized and configured element inserted inside an existing air intake adaptor and said air intake deflector being situated between two separate spaced apart holes leading to two separate carburetors so as to reduce turbulence to the air directed towards said carburetors, said air intake deflector further comprising a sloped surface starting at an apex and sloping on two generally concave surfaces, one for each of said two holes.

* * * * *